US005521357A

United States Patent [19]

Lock et al.

[11] Patent Number: 5,521,357

[45] Date of Patent: May 28, 1996

[54] HEATING DEVICE FOR A VOLATILE MATERIAL WITH RESISTIVE FILM FORMED ON A SUBSTRATE AND OVERMOLDED BODY

[75] Inventors: William L. Lock; Dennis L. DuBois, both of North Webster, Ind.

[73] Assignee: Heaters Engineering, Inc., North Webster, Ind.

[21] Appl. No.: 977,524

[22] Filed: Nov. 17, 1992

[51] Int. Cl.[6] ..... H05B 3/00

[52] U.S. Cl. ..... 219/543; 219/544; 219/541; 338/312; 338/308; 338/275; 392/390; 239/34

[58] Field of Search ..... 219/543, 544, 219/521, 541, 522, 528; 338/308, 309, 307, 312, 322, 275, 276; 29/620; 222/146.5; 239/135, 136; 392/390, 392, 386

[56] References Cited

U.S. PATENT DOCUMENTS

| | | | |
|---|---|---|---|
| 1,646,535 | 10/1927 | Horton | 338/307 |
| 2,786,925 | 3/1957 | Kahan | 338/307 |
| 3,041,436 | 6/1962 | Brady | 219/203 |
| 3,349,722 | 10/1967 | Davis | 219/541 |
| 3,441,895 | 4/1969 | Schwartz | 338/307 |
| 3,534,148 | 10/1970 | Bange | 338/307 |
| 3,569,787 | 3/1971 | Palmer | 219/267 |
| 3,629,781 | 12/1971 | Helgeland | 338/276 |
| 3,659,245 | 4/1972 | Payne | 338/312 |
| 3,772,452 | 11/1973 | Usowski | 338/275 |
| 3,775,725 | 11/1973 | Endo | 338/308 |
| 3,887,788 | 6/1975 | Seibel et al. . | |
| 4,320,165 | 3/1982 | Cash | 338/312 |
| 4,333,069 | 6/1982 | Worth et al. | 338/322 |
| 4,342,020 | 7/1982 | Utner et al. | 338/308 |
| 4,396,826 | 8/1983 | Orcutt et al. | 219/522 |
| 4,436,358 | 3/1984 | Coldren et al. . | |
| 4,485,297 | 11/1984 | Grise et al. . | |
| 4,485,370 | 11/1984 | Poisel . | |
| 4,500,865 | 2/1985 | Tanaka et al. | 338/307 |
| 4,528,546 | 7/1985 | Paoli . | |
| 4,628,187 | 12/1986 | Sekiguchi et al. | 338/308 |
| 4,638,150 | 1/1987 | Whitney . | |
| 4,688,866 | 8/1987 | Legrady . | |
| 4,697,165 | 9/1987 | Ishiguro et al. . | |
| 4,724,182 | 2/1988 | Kato et al. . | |
| 4,730,103 | 3/1988 | Hawkins . | |
| 4,733,056 | 3/1988 | Kojima et al. | 338/308 |
| 4,777,718 | 10/1988 | Henderson et al. | 29/620 |
| 4,785,150 | 11/1988 | Kojima et al. . | |
| 4,795,883 | 1/1989 | Glucksman et al. . | |
| 4,798,935 | 1/1989 | Pezaris . | |

(List continued on next page.)

FOREIGN PATENT DOCUMENTS

| | | | |
|---|---|---|---|
| 6-162306 | 6/1994 | Japan | 222/146.5 |

*Primary Examiner*—John A. Jeffery
*Attorney, Agent, or Firm*—Barnes & Thornburg

[57] ABSTRACT

A heater apparatus includes a substrate, a resistive film formed on a first portion of the substrate, and first and second conductive leads formed on the substrate engaging the resistive film. First and second electrodes are coupled to the first and second conductive leads, respectively. The heater apparatus also includes an overmolded body made of an insulating material formed on the substrate to encapsulate the resistive film, the first and second conductive leads, and a portion of the first and second electrodes in an insulating material. The substrate is formed to include first and second apertures in close proximity to the first and second conductive leads, respectively. The first and second electrodes each include a tab portion extending through the first and second apertures, respectively. The tab portions are deformed so that the tab portion of the first electrode engages the first conductive lead and the tab portion of the second electrode engages the second conductive lead. The apparatus further includes a resistive film formed on a second portion of the substrate, and third and fourth conductive leads formed on the substrate engaging the resistive film on the second portion of the substrate. An electrical component is electrically coupled to the third and fourth conductive leads. The overmolded body is configured to surround at least a portion of the electrical component in insulating material to couple the electrical component to the heating apparatus.

30 Claims, 2 Drawing Sheets

U.S. PATENT DOCUMENTS

| | | | |
|---|---|---|---|
| 4,804,823 | 2/1989 | Okuda et al. . | |
| 4,806,739 | 2/1989 | Kojima et al. . | |
| 4,849,255 | 7/1989 | Grise et al. . | |
| 4,849,606 | 7/1989 | Martens, III et al. | 392/390 |
| 4,873,507 | 10/1989 | Antonas | 338/275 |
| 4,883,947 | 11/1989 | Murase et al. . | |
| 4,912,306 | 3/1990 | Grise et al. . | |
| 4,952,903 | 8/1990 | Shibata et al. . | |
| 4,968,964 | 11/1990 | Nagai et al. | 338/22 R |
| 4,977,309 | 12/1990 | Uchida | 219/541 |
| 5,204,655 | 4/1993 | Yajima et al. | 338/308 |
| 5,213,523 | 5/1993 | Hygema et al. | 439/620 |
| 5,252,944 | 10/1993 | Caddock, Jr. | 338/260 |
| 5,291,178 | 3/1994 | Strief et al. | 338/226 |
| 5,304,977 | 4/1994 | Caddock, Jr. | 338/275 |
| 5,331,134 | 7/1994 | Kimura | 219/543 |

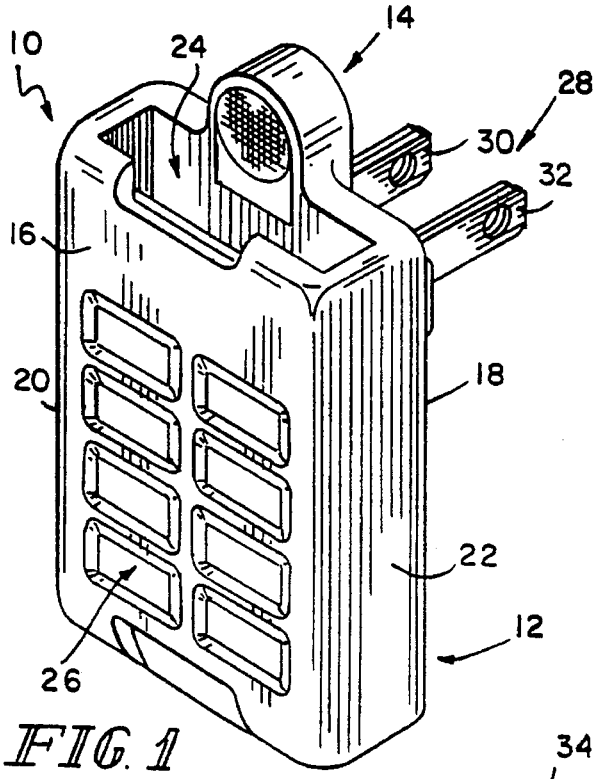
FIG. 1
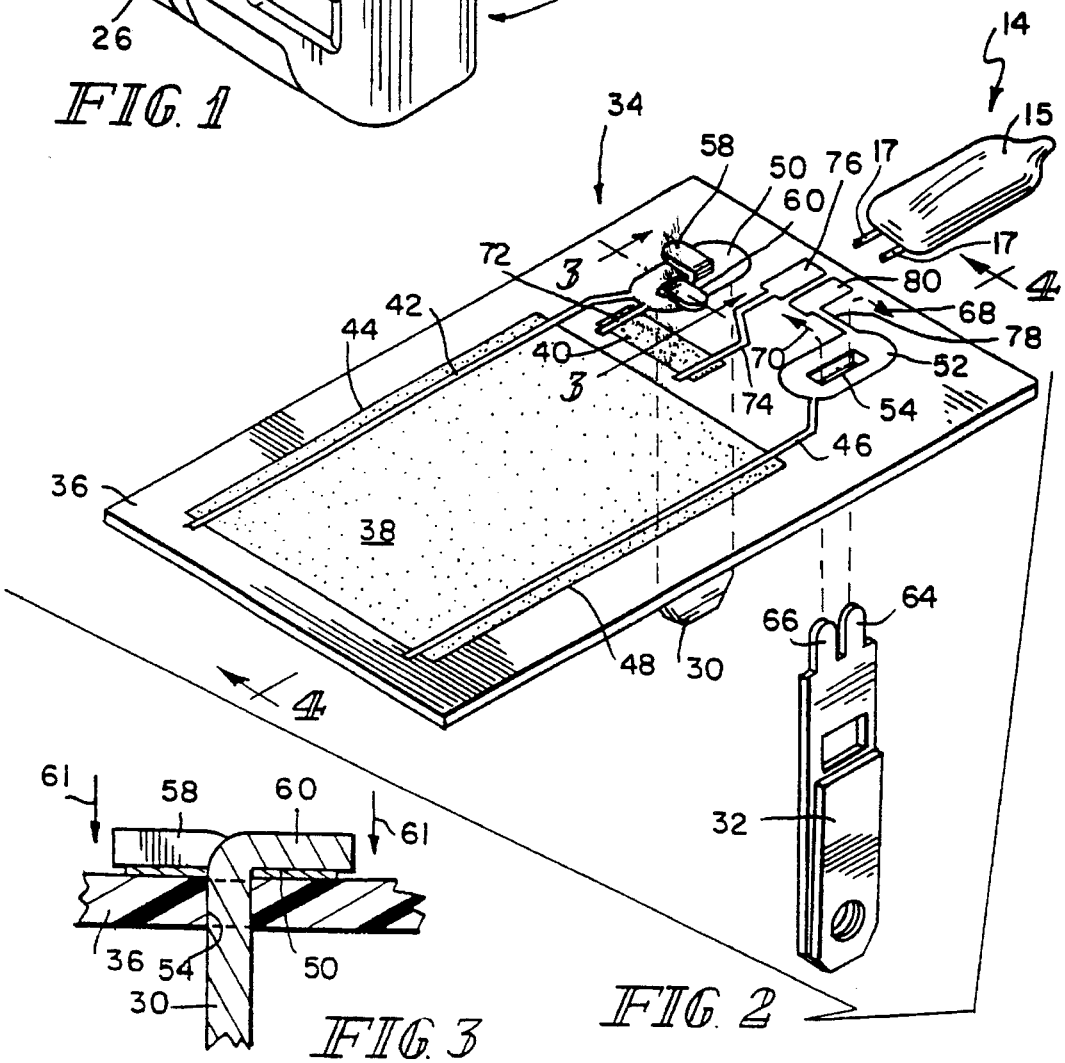
FIG. 2
FIG. 3

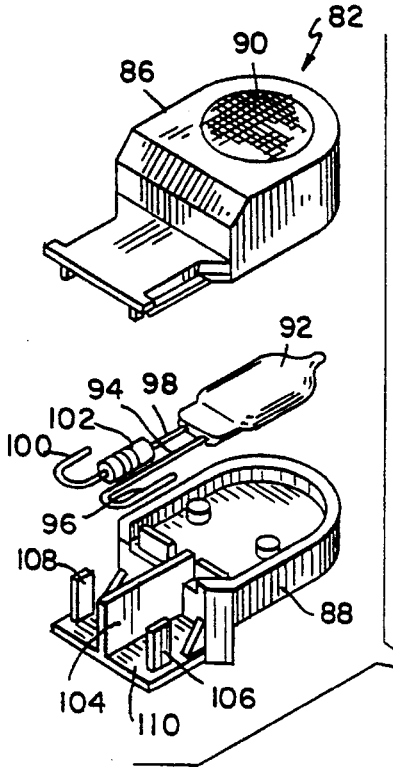
FIG. 4
FIG. 5
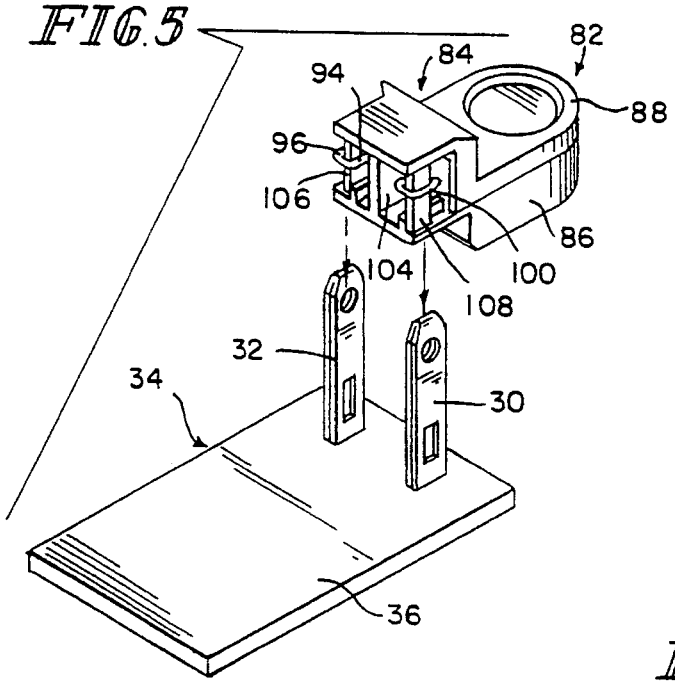
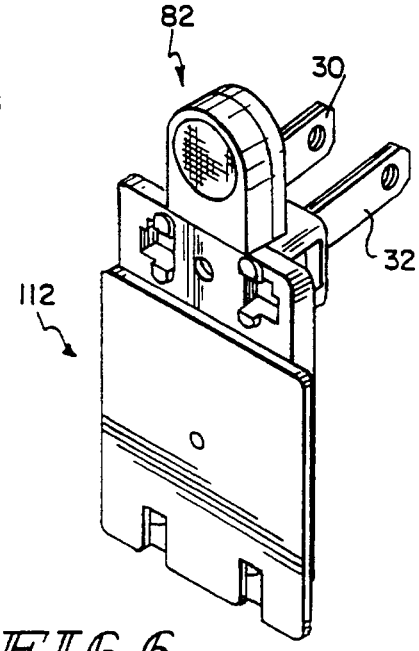
FIG. 6

HEATING DEVICE FOR A VOLATILE MATERIAL WITH RESISTIVE FILM FORMED ON A SUBSTRATE AND OVERMOLDED BODY

BACKGROUND AND SUMMARY OF THE INVENTION

The present invention relates to an apparatus and method for making an electrical heating device. More particularly, the present invention relates to the use of conductive and non-conductive inks to form a heating device on a substrate which is then encapsulated in an insulating material to provide a body portion of the heating device.

An object of the present invention is to provide a heating apparatus which is inexpensive to manufacture, reliable, and which can be used for a variety of heating applications. For instance, the heating device for the present invention may be used as a liquid heater for heating water, coffee, tea, coolants, glues, oils, or other suitable liquids. In addition, the heating device of the present invention can be used as a dispenser to change a solid or liquid into a gaseous state. This can be used to dispense fragrances, insect repellents, vapors for health care purposes, or other suitable substances. The present invention may further by used for thermostat heaters, heaters for automotive applications such as battery warmers or mirror heaters, or for heating various other types of substrate materials.

A first aspect of the invention is the provision of a substrate material to which a polymer thick film (PTF) carbon ink is applied. The substrate material must meet certain temperature requirements so that it will not melt or deform at the designed heater temperature requirements. Examples of substrate materials which may be used include ceramic, glass, silicone, or printed circuit board material. The substrate size will depend on the heat requirements.

A second aspect of the invention is the application of PTF carbon ink to the substrate to form a resistive heater. The carbon ink is applied to a first portion substrate using a screen press or by a spraying method. The geometric shape of the PTF ink heater is a matter of design and will be determined by application specific requirements.

A third aspect of the invention is the application of conductive leads to the substrate. In order to produce a PTF carbon ink heater which produces the required amount of heat, low resistance leads are needed to carry electrical current to the PTF carbon ink. These leads may be produced using a PTF base material impregnated with silver or copper particles. The PTF conductive lead material may be applied to the substrate before the PTF carbon ink is applied, or it may be applied over the PTF carbon ink, as long as the conductive leads and the carbon ink overlap. The PTF conductive lead material may be applied to the substrate by printing or spraying methods.

A fourth aspect of the invention is coupling first and second electrodes to the conductive leads. The electrodes provide power to the conductive leads and to the carbon ink to cause heating of the device.

A fifth (and optional) aspect of the invention is the application of a resistive film to a second portion of the substrate and the application of a conductive film to the substrate to form third and fourth conductive leads engaging the resistive film on the second portion of the substrate. An electrical component may be coupled to the third and fourth conductive leads prior to encapsulating the heater apparatus.

A sixth aspect of the invention is overmolding a plastic body around the heater. The method used to form the plastic body is preferably an injection molding process which molds an insulating plastic material around the substrate and PTF carbon and conductive heater. Examples of plastic materials which may be used include but are not limited to polypropylene, polyphenylene sulfide, polyetherimide, polycarbonates, or polyvinyl chloride.

According to the present invention, a heater apparatus includes a substrate, a resistive film formed on a first portion of the substrate, and first and second conductive leads formed on the substrate engaging the resistive film. First and second electrodes are coupled to the first and second conductive leads, respectively. The heater apparatus also includes an overmolded body made of an insulating material formed on the substrate to encapsulate the resistive film, the first and second conductive leads, and a portion of the first and second electrodes in an insulating material.

The substrate is formed to include first and second apertures in close proximity to the first and second conductive leads, respectively. The first and second electrodes each include a tab portion extending through the first and second apertures, respectively. The tab portions are deformed so that the tab portion of the first electrode engages the first conductive lead and the tab portion of the second electrode engages the second conductive lead.

The apparatus may further include a resistive film formed on a second portion of the substrate, and third and fourth conductive leads formed on the substrate engaging the resistive film on the second portion of the substrate. An electrical component is electrically coupled to the third and fourth conductive leads. The overmolded body is configured to surround at least a portion of the electrical component in insulating material to couple the electrical component to the heating apparatus.

According to a second embodiment of the present invention, an electrical component is provided which includes first and second conductive leads extending from the electrical component. The electrical component is configured to be slidably inserted between said first and second electrodes of the heating apparatus so that the first conductive lead engages the first electrode and the second conductive lead engages the second electrode, respectively, to couple the electrical component to the heating apparatus. The electrical component includes an insulated housing and the first and second conductive leads extend outwardly from the insulated housing. The insulated housing includes first and second contact support posts abutting the first and second conductive leads. The first and second contact support posts hold the first and second conductive leads against the first and second electrodes, respectively, upon insertion of the electrical component between said first and second electrodes. The insulated housing further includes a partition formed between the first and second contact support posts for separating the first conductive lead from the second conductive lead. The insulated housing still further includes a front portion and a rear portion coupled to the front portion to define an interior region therebetween and a current carrying device positioned within the interior region. A voltage dropping resistor is coupled to the first conductive lead to supply current to the current carrying device.

Also according to the present invention, a method is provided for making a heating apparatus. The method includes the steps of providing a generally rigid substrate, applying a resistive film to a first portion of the substrate, and applying a conductive film to the substrate to form first and second conductive leads engaging the resistive film on the first portion of the substrate. The method also includes the steps of coupling first and second electrodes to the first and second conductive leads, respectively, and molding an insulating material to the substrate to form a generally rigid insulating body encapsulating the resistive and conductive films.

The coupling step of the method includes forming first and second apertures in the substrate in close proximity to the first and second conductive leads, respectively, and inserting a portion of the first and second electrodes through the first and second apertures, respectively. The coupling step also includes deforming the portion of the first and second electrodes extending through the first and second apertures to engage the first and second conductive leads, respectively, thereby electrically coupling the first and second electrodes to the first and second conductive leads.

The method may further include the steps of applying a resistive film to a second portion of the substrate and applying conductive film to the substrate to form third and fourth conductive leads engaging the resistive film on the second portion of the substrate. This provides a supplemental contact for electrically coupling an electrical component to the heater apparatus. The method still further includes the step of coupling an electrical component to the third and fourth conductive leads prior to the molding step. The molding step also encapsulates at least a portion of the electrical component in insulating material to mechanically couple the electrical component to the heating apparatus.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which:

FIG. 1 is a perspective view of an electrically heated vapor dispensing apparatus which includes an integral light assembly constructed according to the present invention.

FIG. 2 is an exploded perspective view illustrating the configuration of a heater assembly coupled to a substrate and a light for coupling to conductive pads on the substrate.

FIG. 3 is a sectional view taken along lines 3—3 of FIG. 2 illustrating coupling of an electrode to a conductive lead formed on the substrate.

FIG. 4 is an exploded perspective view illustrating a second configuration of a light unit portion which can be coupled to the electrodes of the heater assembly.

FIG. 5 is a perspective view illustrating the light unit portion of FIG. 4 as it is inserted between the electrodes of the heater assembly.

FIG. 6 is a perspective view illustrating the light unit portion and the heater assembly encapsulated in a molded plastic material.

DETAILED DESCRIPTION OF THE DRAWINGS

Referring now to the drawings, FIG. 1 illustrates an assembly 10 constructed according to the present invention. The assembly 10 includes a heater unit portion 12 and a light unit portion 14. Heater unit portion 12 includes a front wall 16, a rear wall 18, and opposite side walls 20 and 22. The assembly 10 is formed to include a slot 24 extending along heater unit portion 12 for receiving a container (not shown) therein. The container can be filled with any suitable air treating volatile material, such as an air deodorizer, insecticide, or the like. Front wall 16 is formed to include a plurality of apertures 26 to permit the volatile material to escape from the slot 24. Assembly 10 is designed to be plugged into a conventional wall outlet by power plug assembly 28 including a first blade electrode 30 and a second blade electrode 32 spaced apart from the first blade electrode 30 by a fixed distance. Light unit portion 14 is electrically coupled to first and second blade electrodes 30 and 32 as discussed in detail below. Light unit portion 14 is continuously illuminated after the assembly 10 is plugged into a wall outlet to provide a night light. The combination of heater unit portion 12 and light unit portion 14 permits a single wall outlet socket to be used for both the volatile material dispenser and a night light. This leaves additional wall outlet sockets available for use with other electrical appliances.

The heater assembly 34 of the present invention is best illustrated in FIG. 2. In addition, a first embodiment of the light unit portion 14 is also illustrated in FIG. 2. Light unit portion 14 preferably includes a neon light bulb 15 and leads 17 designed to be coupled to contact surfaces 76 and 80 of heater assembly 34 as discussed below in detail.

The heater assembly 34 includes a substrate 36. Substrate 36 is preferably formed from a rigid material. It is required that substrate 36 meet temperature requirements so that the substrate 36 will not melt or deform during molding of a plastic body around the heater assembly 34 or during operation of the heater. Illustratively, substrate 36 may be formed from a material such as ceramic, glass, silicone, or printed circuit board material. The size of substrate 36 varies depending upon the application in which the heater assembly 34 is used.

Polymer thick film (PTF) carbon ink is applied to substrate 36 in areas marked 38 and 40. The PTF carbon ink on first portion 38 provides a resistive heater component to produce heat as current passes through the resistive portion 38 of heater assembly 34. The size of resistive portion 38 is dependent upon the heating requirements of heater assembly 34. The carbon ink may be applied to areas 38 and 40 using a screen press or by a spraying method. Carbon ink section 40 provides a voltage dropping resistor for light unit portion 14, as discussed in more detail below.

PTF conductive ink is also applied to the surface of substrate 36. A first conductive lead 42 is formed to overlap resistive surface 38 adjacent side edge 44. A second conductive lead 46 is formed to overlap resistive surface 38 adjacent second side edge 48. First conductive lead 42 includes a first contact surface 50. Second conductive lead 46 includes a second contact surface 52. It is understood that the conductive ink may be applied first to substrate 36, followed by the resistive ink, as long as the conductive ink and carbon ink overlap. Apertures 54 are formed in the substrate within contact sections 50 and 52.

A first blade electrode 30 including tabs 58 and 60 is inserted through aperture 54 in substrate 36. Tabs 58 and 60 are then deformed or bent to be perpendicular to blade electrode 30 and engage contact surface 50 on substrate 36. This is best illustrated in FIG. 3. Deformation of tabs 58 and 60 cause tabs 58 and 60 to apply a force against contact section 50 in the direction of arrows 61 to maintain electrical contact between contact section 50 and tabs 58 and 60 of electrode 30.

Second blade electrode 32 includes tabs 64 and 66. Tabs 64 and 66 are inserted through aperture 54 formed in contact section 52 of substrate 36. Tab 64 is bent in the direction of arrow 68 in FIG. 2, and tab 66 is bent in the direction of arrow 70 so that tabs 64 and 66 engage contact section 52 in a manner similar to the engagement of tabs 58 and 60 with contact surface 50 illustrated in FIG. 3.

A conductive lead 72 coupled to contact surface 50 overlaps second resistive section 40. A conductive lead 74 formed on substrate 36 overlaps an opposite end of resistive section 40. Conductive lead 74 terminates in a contact surface 76. A conductive lead 78 is coupled at one end to contact section 52 and at a second end to a contact surface 80. Contact surfaces 76 and 80 provide contacts for coupling leads 17 of light unit portion 14 to heater assembly 34. Resistive section 40 provides a voltage dropping resistor for light unit portion 14.

During operation of heater assembly 34, first and second blade electrodes 30 and 32 are plugged into a conventional wall outlet. Current flows through first electrode 30, through contact surface 50, conductive lead 42, resistive section 38, conductive lead 46, contact section 52, and blade electrode 32 to complete the heater loop. Current passing through resistive section 38 causes resistive section 38 to produce heat.

Resistive section 40 provides a voltage dropping resistor for light unit portion 14. Therefore, current flows through first blade electrode 56, first contact section 50, lead 72, resistive section 40, lead 70, contact 76, light unit portion 14, contact 80, conductive lead 78, contact section 52, and second blade electrode 62 to complete the light assembly loop.

Another embodiment of a light unit portion which may be used in accordance with the present invention is illustrated in FIGS. 4 and 5. In this embodiment, the light unit portion 82 includes an insulated base or housing 84. Illustratively, housing 84 includes a front section 86 and a rear section 88. In addition, housing 84 may be a single piece housing. Front and rear sections 86 and 88 are preferably formed from a rigid plastic material which transmits light. Front section 86 includes a light defusing section 90 to defuse light emitted from a lamp 92 located inside insulated housing 84. A first conductive lead 94 and a second conductive lead 98 are coupled to lamp 92. First lead 94 includes a first contact section 96. Second lead 98 includes a second contact section 100. A voltage dropping resistor 102 is coupled in series with lead 98 to provide current to lamp 92. Therefore, the second embodiment of the invention does not require use of resistive section 40 as the voltage dropping resistor. Rear section 88 of insulated housing 84 includes a center partition 104, a first contact support post 106, and a second contact support post 108, each extending upwardly from a rear surface 110 of rear section 88. Leads 94 and 98 are positioned on opposite sides of partition 104 to separate the leads 94 and 98.

Housing 84 is fabricated to provide exposed surfaces along which contact sections 96 and 100 are positioned. The exposed surfaces may be along the external sides of housing 84 as illustrated in FIGS. 4 and 5. The assembled light unit portion 84 is illustrated in FIG. 5. First and second contact surfaces 96 and 100 abut the first and second contact support posts 106 and 108, respectively. Light unit portion 82 is inserted between the electrodes 30 and 32 of heater assembly 34 as best illustrated in FIG. 5. After light unit portion 82 is attached to heater assembly 34, heater assembly 34 and light unit portion 82 are encapsulated by molding plastic around the heater assembly 34 and light unit portion 82 in a mold in a conventional manner to form a molded subassembly 112 illustrated in FIG. 6. Subassembly 112 is then encapsulated by molding plastic around subassembly 112 in a mold in a conventional manner to form the heater assembly 10 illustrated in FIG. 1. In other words, a two-step molding process is used to form heater assembly 10 from heater assembly 34 and light unit portion 84. Depending upon the plastic selected, standard molding temperatures and pressures may be used.

From the preceding description of the preferred embodiments, it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

What is claimed is:

1. An apparatus for heating a volatile material comprising:

a substrate;

a resistive film formed on a first portion of the substrate;

first and second conductive leads formed on the substrate engaging the resistive film;

first and second electrodes coupled to the first and second conductive leads, respectively; and an overmolded body made of insulating material and formed on the substrate to encapsulate the resistive film, the first and second conductive leads, and a portion of the first and second electrodes, said overmolded body forming a slot adjacent the resistive film to receive the material to be heated.

2. The apparatus of claim 1, wherein the substrate is formed to include first and second apertures in close proximity to the first and second conductive leads, respectively, and the first and second electrodes each include a tab portion extending through the first and second apertures, respectively.

3. The apparatus of claim 2, wherein the tab portions are deformed so that the tab portion of the first electrode engages the first conductive lead and the tab portion of the second electrode engages the second conductive lead.

4. The apparatus of claim 1, further comprising a resistive film formed on a second portion of the substrate, and third and fourth conductive leads formed on the substrate engaging the resistive film on the second portion of the substrate.

5. The apparatus of claim 4, further comprising an electrical component electrically coupled to the third and fourth conductive leads.

6. The apparatus of claim 5, wherein the overmolded body is configured to surround at least a portion of the electrical component in insulating material to couple the electrical component to the heating apparatus.

7. The apparatus of claim 1, wherein the overmolded body provides a rigid housing made of a plastic material.

8. The apparatus of claim 1, further comprising an electrical component including first and second conductive leads extending from the electrical component, the electrical component being configured to be slidably inserted between said first and second electrodes so that the first conductive lead engages the first electrode and the second conductive lead engages the second electrode, respectively, to couple the electrical component to the heating apparatus.

9. The apparatus of claim 8, wherein the electrical component includes an insulated housing and the first and second conductive leads extend outwardly from the insulated housing.

10. The apparatus of claim 9, wherein the insulated housing includes first and second contact support posts abutting the first and second conductive leads, the first and second contact support posts holding the first and second conductive leads against the first and second electrodes, respectively, upon insertion of the electrical component between said first and second electrodes.

11. The apparatus of claim 10, wherein the insulated housing further includes a partition formed between the first and second contact support posts for separating the first conductive lead from the second conductive lead.

12. The apparatus of claim 9, wherein the insulated housing includes a front portion and a rear portion coupled to the front portion to define an interior region therebetween and a current carrying device positioned within the interior region.

13. The apparatus of claim 12, further comprising a voltage dropping resistor coupled to the first conductive lead.

14. The apparatus of claim 1, wherein the body includes first and second generally opposing walls that define the slot.

15. An apparatus for heating a volatile material comprising:

a substrate;

a resistive film formed on first and second portions of the substrate;

first and second conductive leads formed on the substrate engaging the resistive film on the first portion of the substrate;

first and second electrodes coupled to the first and second conductive leads, respectively;

third and fourth conductive leads formed on the substrate engaging the resistive film on the second portion of the substrate; and means coupled to the substrate for encapsulating the resistive film, the conductive leads, and a portion of the first and second electrodes in an insulating material, and for securing the volatile material to be heated adjacent the resistive film, the encapsulating and securing means including a body formed to include first and second generally opposing walls that define a slot in which the volatile material is disposable to secure the volatile material adjacent the resistive film.

16. The apparatus of claim 15, wherein the substrate is formed to include first and second apertures in close proximity to the first and second conductive leads, respectively, and the first and second electrodes each include a tab portion extending through the first and second apertures, respectively.

17. The apparatus of claim 16, wherein the tab portions are deformed so that the tab portion of the first electrode engages the first conductive lead and the tab portion of the second electrode engages the second conductive lead.

18. The apparatus of claim 15, further comprising an electrical component electrically coupled to the third and fourth conductive leads.

19. The apparatus of claim 18, wherein the encapsulating and securing means surrounds at least a portion of the electrical component in insulating material to couple the electrical component to the heating apparatus.

20. The apparatus of claim 15, wherein the encapsulating and securing means includes a generally rigid body portion made of a plastic material.

21. The apparatus of claim 15, further comprising an electrical component including first and second conductive leads extending from the electrical component, the electrical component being configured to be slidably inserted between said first and second electrodes so that the first conductive lead engages the first electrode and the second conductive lead engages the second electrode, respectively, to couple the electrical component to the heating apparatus.

22. The apparatus of claim 21, wherein the electrical component includes an insulated housing and the first and second conductive leads extend outwardly from the insulated housing.

23. The apparatus of claim 22, wherein the insulated housing includes first and second contact support posts abutting the first and second conductive leads, the first and second contact support posts holding the first and second conductive leads against the first and second electrodes, respectively, upon insertion of the electrical component between said first and second electrodes.

24. The apparatus of claim 23, wherein the insulated housing further includes a partition formed between the first and second contact support posts for separating the first conductive lead from the second conductive lead.

25. The apparatus of claim 22, wherein the insulated housing includes a front portion and a rear portion coupled to the front portion to define an interior region therebetween and a current carrying device positioned within the interior region.

26. The apparatus of claim 25, further comprising a voltage dropping resistor coupled to the first conductive lead.

27. A heating apparatus comprising:

a substrate;

a resistive film formed on a first portion of the substrate;

first and second conductive leads formed on the substrate engaging the resistive film;

first and second electrodes coupled to the first and second conductive leads, respectively;

an overmolded body made of insulating material formed on the substrate to encapsulate the resistive film, the first and second conductive leads, and a portion of the first and second electrodes; and an electrical component including first and second conductive leads extending from the electrical component, the electrical component being configured to be slidably inserted between said first and second electrodes so that the first conductive lead engages the first electrode and the second conductive lead engages the second electrode, respectively, to couple the electrical component to the heating apparatus;

wherein the electrical component includes an insulated housing and the first and second conductive leads extend outwardly from the insulated housing, the insulated housing having first and second contact support posts abutting the first and second conductive leads, the first and second contact support posts holding the first and second conductive leads against the first and second electrodes, respectively, upon insertion of the electrical component between said first and second electrodes; and further wherein the insulated housing further includes a partition formed between the first and second contact support posts for separating the first conductive lead from the second conductive lead.

28. A heating apparatus comprising:

a substrate;

a resistive film formed on a first portion of the substrate;

first and second conductive leads formed on the substrate engaging the resistive film;

first and second electrodes coupled to the first and second conductive leads, respectively;

an overmolded body made of insulating material formed on the substrate to encapsulate the resistive film, the first and second conductive leads, and a portion of the first and second electrodes;

an electrical component including first and second conductive leads extending from the electrical component, the electrical component being configured to be slidably inserted between said first and second electrodes so that the first conductive lead engages the first electrode and the second conductive lead engages the second electrode, respectively, to couple the electrical component to the heating apparatus; and a voltage dropping resistor coupled to the first conductive lead;

wherein the electrical component includes an insulated housing and the first and second conductive leads extend outwardly from the insulated housing; and further wherein the insulated housing includes a front portion and a rear portion coupled to the front portion to define an interior region therebetween and a current carrying device positioned within the interior region.

29. A heating apparatus comprising:

a substrate;

a resistive film formed on first and second portions of the substrate;

first and second conductive leads formed on the substrate engaging the resistive film on the first portion of the substrate;

first and second electrodes coupled to the first and second conductive leads, respectively;

third and fourth conductive leads formed on the substrate engaging the resistive film on the second portion of the substrate;

means coupled to the substrate for encapsulating the resistive film, the conductive leads, and a portion of the first and second electrodes in an insulating material; and an electrical component including first and second conductive leads extending from the electrical component, the electrical component being configured to be slidably inserted between said first and second electrodes so that the first conductive lead engages the first electrode and the second conductive lead engages the second electrode, respectively, to couple the electrical component to the heating apparatus;

wherein the electrical component includes an insulated housing and the first and second conductive leads extend outwardly from the insulated housing, the insulated housing having first and second contact support posts abutting the first and second conductive leads, the first and second contact support posts holding the first and second conductive leads against the first and second electrodes, respectively, upon insertion of the electrical component between said first and second electrodes; and further wherein the insulated housing further includes a partition formed between the first and second contact support posts for separating the first conductive lead from the second conductive lead.

30. A heating apparatus comprising:

a substrate;

a resistive film formed on first and second portions of the substrate;

first and second conductive leads formed on the substrate engaging the resistive film on the first portion of the substrate;

first and second electrodes coupled to the first and second conductive leads, respectively;

third and fourth conductive leads formed on the substrate engaging the resistive film on the second portion of the substrate;

means coupled to the substrate for encapsulating the resistive film, the conductive leads, and a portion of the first and second electrodes in an insulating material;

an electrical component including first and second conductive leads extending from the electrical component, the electrical component being configured to be slidably inserted between said first and second electrodes so that the first conductive lead engages the first electrode and the second conductive lead engages the second electrode, respectively, to couple the electrical component to the heating apparatus; and a voltage dropping resistor coupled to the first conductive lead;

wherein the electrical component includes an insulated housing and the first and second conductive leads extend outwardly from the insulated housing; and further wherein the insulated housing includes a front portion and a rear portion coupled to the front portion to define an interior region therebetween and a current carrying device positioned within the interior region.

* * * * *